US007070899B2

(12) United States Patent
Yanagida et al.

(10) Patent No.: US 7,070,899 B2
(45) Date of Patent: Jul. 4, 2006

(54) ELECTROSTATIC LATENT IMAGE DEVELOPER, IMAGE FORMING METHOD, AND IMAGE FORMING APPARATUS

(75) Inventors: Kazuhiko Yanagida, Minamiashigara (JP); Nobumasa Furuya, Ebina (JP); Takashi Yukutake, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 292 days.

(21) Appl. No.: 10/606,776

(22) Filed: Jun. 27, 2003

(65) Prior Publication Data

US 2004/0101776 A1 May 27, 2004

(30) Foreign Application Priority Data

Nov. 26, 2002 (JP) ..... 2002-342894

(51) Int. Cl.
*G03G 9/08* (2006.01)

(52) U.S. Cl. ..... 430/110.3; 430/110.4; 430/111.41; 430/124

(58) Field of Classification Search ..... 430/110.3, 430/110.4, 111.41, 124
See application file for complete search history.

(56) References Cited

U.S. PATENT DOCUMENTS 5,932,387 A * 8/1999 Yamamoto et al. ..... 430/111.1
6,153,346 A * 11/2000 Maehata et al. ..... 430/137.14
2001/0053492 A1* 12/2001 Suwabe et al. ..... 430/110.3
2002/0061133 A1* 5/2002 Ohta et al. ..... 382/176

FOREIGN PATENT DOCUMENTS

JP A 11-344837 12/1999
JP A 2001-147552 5/2001

* cited by examiner

*Primary Examiner*—John L Goodrow
(74) *Attorney, Agent, or Firm*—Oliff & Berridge, PLC

(57) ABSTRACT

An electrophotographic developer is provided for realizing high-quality images and superior reproducibility of laser dots in a low coverage region and reduced unevenness of color in halftone solid images. The electrophotographic developer includes a toner and a carrier. The toner has a shape factor of 140 or less and a volume average particle size distribution GSDv of 1.3 or less. The carrier has a coat resin layer on a core material, the coat resin layer containing a conductive powder. The core material has a dynamic electric resistivity of 1 Ω·cm or less under an electric field of $10^4$ V/cm in a form of a magnetic brush. The conductive powder has an electric resistivity of $10^1$ Ω·cm or greater and $10^6$ Ω·cm or less. The carrier has an electric resistivity in a range between 10 and $1\times10^8$ Ω·cm. An image forming method is also provided wherein the electrophotographic developer is used for development in a developing stage.

9 Claims, 2 Drawing Sheets

ELECTROSTATIC LATENT IMAGE DEVELOPER, IMAGE FORMING METHOD, AND IMAGE FORMING APPARATUS

BACKGROUND OF THE INVENTION

1. Field of the Invention

The present invention relates to an electrostatic charge image developer for use in developing an electrostatic charge images formed by electrophotography or by electrostatic recording.

2. Description of the Related Art

Various methods for visualizing image information as electrostatic charge images, such as electrophotography, are now widely used in various fields. In electrophotography, an electrostatic latent image is formed on a photoreceptor in two stages, a charging stage and in an exposure stage. The electrostatic latent image is then developed using a developer including a toner and is visualized through transfer and fixation stages. Developers used for this purpose include a two component developer comprising a toner and a carrier and a single component developer used as a single entity, such as a magnetic toner. Of these, the two component developers are widely in use because of advantages such as, for example, that, in the two component developers, the functionalities as the developer are separated as the carrier performs the functions of stirring, transfer, charging, etc. of the developer and that the developer does not include a magnetic powder which is advantageous in color images because the coloring is superior.

In general, toners are manufactured through a mixing and grinding method which includes the steps of molten dispersion of a thermoplastic resin with a pigment, a charge control agent, and a release agent such as wax; cooling; fine grinding; and classifying. In order to improve the flowability and cleanability (the characteristic to be easily cleaned), in some cases, inorganic fine particles or organic fine particles may be added on the surface of the toner particle as necessary.

In recent years, with the rapid development of today's sophisticated information society, there are increasing demands for the ability to provide high image quality information documents constructed in various methods. To address these demands, currently, significant efforts are devoted to researches for improving image quality in various image forming methods. This trend is also true for the image formation through electrophotography, and, in particular, in order to realize a higher resolution image in a color image formation in electrophotography, efforts have been made for data processing techniques of images read by scanners and improvements in digitization techniques in writing with laser. In addition, efforts have been made in research and development of techniques for obtaining smaller size toners, for shaper (narrower) particle size distribution of toners, and for spherical toner particles. For example, when an image is formed using toners having a wide particle size distribution, the toners having a smaller particle size in the particle size distribution cause significant problems such as contamination of developing roller, charging roller, charging blade, photoreceptor, carrier, etc. and spreading of toners. Because of this, it becomes difficult to simultaneously achieve high image quality and high reliability. Such a toner having a wide particle size distribution is also disadvantageous in that reliability is low in a system having functions such as a cleaning function or a toner recycling function. With regard to obtaining a spherical toner particle, the shape of the toner particle significantly affects precision transferability of the toner particle in the transfer stage. That is, the precision transferability becomes higher as the shape is more spherical because the contact area between the toner and the carrier can be maintained at the minimum until the final image is obtained, resulting in a possible improvement in the final image quality characteristics such as reproducibility of fine lines. As described, in order to simultaneously achieve high image quality and high reliability, it is necessary to reduce the particle size of the toner, sharpen the particle size distribution of the toner to obtain a more uniform particle size and a more spherical shape for more uniform surface conditions.

However, because the spherical toners have more uniform surface structures in comparison to randomly-shaped toners such as toners obtained through a grinding process, the distribution of adhering strength with the carrier is narrow, and because the particle size distribution has a narrow width, the distribution of forces applied to the individual toner by a developing electric field has a narrow width. Because of a combination of these two characteristics, as shown in FIG. 1 which shows relationships between the electric filed and amount of development, the spherical toner has a tendency that the developing amount rises, with respect to the developing electric field, in a sharper manner compared to the relationship in randomly shaped toners obtained by grinding. In today's digital color copiers, a latent image is formed by with a laser. In a solid section, the entire surface is exposed and a uniform potential pattern is formed in a wide area. On the other hand, in a halftone region where the image density is lower, the exposure of the laser beam is controlled so that the writing process is performed in a dot-shape or line-shape in order to from a pixel having a very small area of 1 $mm^2$ or less. In addition, the density of the pixel (hereinafter referred to as "input coverage" in the specification) is controlled to reproduce a halftone. The pixels are uniformly exposed with the potential distribution on the photoreceptor and profile of the developing electric field varying depending on the input coverage, that is, in a highlighted section wherein the input coverage is low, the developing electric field is smaller. This does not cause a problem in developing in a region wherein the developing is saturated with respect to the developing electric field such as the solid section and a region of high input coverage. However, in halftone dots having low input coverage, the developing electric field becomes smaller than that for the solid section, and, in some cases, the developing electric field falls out of the saturation range in the electric field-development curve. The electric field felt by the toner depends on the input coverage and becomes lower as the input coverage becomes smaller. Because of this, when a toner having a spherical shape and a narrow distribution in which the density more sensitively responds to the developing electric field is used, in comparison to a ground toner having a wider distribution and random shape, the probability of inability to develop and reproduce in a region of low input coverage is greater. As a result, it is difficult to uniformly develop both the solid section and a region of low input coverage using the spherical toners, and, in some extreme cases, the reproducibility becomes inferior for pixels having an input coverage value smaller than a certain input coverage value. In addition, in some cases, the developing electric field may vary when the distance between the developing roller and the photoreceptor varies due to, for example, deviation of the center. If the developing electric field varies in development of images having an input coverage value of 50 or less on the overall surface, unevenness in images becomes more significant with spherical toners having a sharper development curve with respect to the developing potential compared to ground toners with random shapes. This phenomenon becomes particularly noticeable when the distance between a developing sleeve and photoreceptor (DRS) becomes narrow and the magnitude of the center deviation becomes relatively large compared to the DRS, and also when the peripheral speed of the photoreceptor is high such as in a high-speed copier.

To address this problem, various techniques are employed such as, for example, changing the ratio on the positive side and negative side of an alternating developing bias, but these techniques have not proven too effective so far. Solutions such as an increase in the precision of DRS are not preferable because such solutions causes an increase in cost. Therefore, there is presently no satisfactory method yet.

In order to improve image quality and to significantly reduce toner consumption per page, Japanese Patent Laid-Open Publication No. Hei 11-344837 proposes an electrostatic charge developer comprising a spherical toner having an average volume particle size of approximately 1 μm to 6 μm and a resin-coated carrier having an average volume particle size of 20 μm to 150 μm. In order to obtain high image quality and high image density even when a small size toner is used, Japanese Patent Laid-Open Publication No. 2001-147552 proposes an electrostatic charge developer comprising a toner made by fusion within water-based medium and a resin-coated carrier having a resistivity of $10^3$ Ω·cm–$10^{12}$ Ω·cm. In this reference, the resistivity of the resin-coated carrier is adjusted by the thickness of the coating layer.

Therefore, an advantage of the present invention is that a developer and an image forming method are provided wherein image quality such as reproducibility of fine lines are improved using spherical toners having a sharp particle size distribution and small particle size while eliminating reproduction deficiencies in low input coverage sections which is a disadvantage of spherical toners and wherein density unevenness can be inhibited even in a document containing entirely halftone images.

SUMMARY OF THE INVENTION

As a result of extensive studies of the problems mentioned above, the present inventors have found that, in order to eliminate reproduction deficiency in a low input coverage section which is a disadvantage of spherical toners and to inhibit density unevenness in images such as an overall halftone image, a CMB (Conductive Magnetic Brush) carrier having a low resistivity should be used as the carrier, and, in order to obtain a superior solid image while preventing image deficiencies such as a brush marks and carrier-overs which are disadvantages of the CMB carrier, it is desirable to employ a carrier having the resistivity in a predetermined range. The present inventors have further found that in order to achieve the predetermined range, it is important that the resistivity of the carrier core is lower than a predetermined value and the resistivity of a conductive powder in a coat resin layer and the resistivity of the coat layer are respectively within a predetermined range.

(1) According to one aspect of the present invention, there is provided an electrophotographic developer formed of a toner and a carrier, the developer comprising a toner having a shape factor of 140 or less and a volume average particle size distribution GSDv of 1.3 or less; and an electrophotographic carrier having a coat resin layer on a core material, the coat resin layer containing a conductive powder, the core material having a dynamic electric resistivity of 1 Ω·cm or less under an electric field of $10^4$ V/cm in a form of a magnetic brush, the conductive powder having an electric resistivity of $10^1$ Ω·cm or greater and $10^6$ Ω·cm or less, and the carrier having an electric resistivity in a range between 10 and $1\times10^8$ Ω·cm, wherein the shape factor is defined by an equation, $$\text{Shape Factor}=(ML^2/A)\times(\Pi/4)\times100$$

wherein ML represents the absolute maximum length of the toner and A represents the projected area of the toner, and the volume average particle size distribution GSDv is defined by an equation, $$GSDv=(D84/D16)^{1/2}$$

wherein volume D16 represents a particle size where an accumulated volume in an accumulation distribution from smaller size reaches 16% and volume D84 represents a particle size where the accumulated volume in the accumulation distribution reaches 84%.

In an electrophotographic developer according to this aspect of the present invention, a spherical toner having a small particle size and a sharp particle size distribution may be used as the toner, and a carrier may be used in which the electric resistivity is adjusted to be in a range of 10 Ω·cm to $10^8$ Ω·cm, the adjustment achieved by using a conductive power having an electrical resistivity of $10^1$ Ω·cm or greater and $10^6$ Ω·cm or less to form an intermediate-resistivity coat resin layer having an electric resistivity of 10 Ω·cm to $1\times10^8$ Ω·cm on a low resistivity core material (the core material will also be referred to as "center core" or "core" hereinafter) having a dynamical electric resistivity under an electric field of $10^4$ V/cm of 1 Ω·cm or less in a form of a magnetic brush. With such a structure, it is possible to improve reproducibility in a low input coverage section, uniformity of a halftone section, and reproducibility of solid images while preventing image deficiencies such as brush marks and carrier-overs.

The mechanism through which the advantages of reproducibility in a low input coverage section and uniform reproduction of halftone can be deduced as follows. As described above, because of the spherical shape, the spherical toner has a surface structure having a relatively uniform radius of curvature compared to toners obtained by grinding and having a random shape. As a result of this surface structure, the distribution of the adhesion strength with respect to the carrier is narrow. In addition, because the particle size distribution of the spherical toner is narrow, the distribution of the force acting on the material to which individual toner is to be developed by the developing electric field is narrow. With a combination of these two characteristics, as shown in FIG. 1 which shows the relationship between the developing electric field and the developing amount, the spherical toner has a tendency wherein the developing amount rises more sharply with respect to the developing electric field compared to the randomly shaped toners obtained through grinding. Although no problem occurs for developing in a region where the development is saturated with respect to the developing electric field, in a low input coverage section within a halftone, the electric field acting on the toner when the toner is developed becomes smaller than the solid section, resulting in a possible case wherein the electric field falls outside the saturation range in the developing electric field-developing weight curve. Because the electric field acting on the toner depends on the input coverage and becomes smaller as the input coverage is reduced, in the spherical toners in which the developing amount more sensitively responds to the developing electric field, the tendency for failing to develop and reproduce in a low input coverage region is higher than in the case of a randomly shaped ground toners having a wider distribution. As a result, it is difficult with the spherical toners to uniformly develop a region of large input coverage and a region of small input coverage, and, in extreme cases, the reproducibility becomes inferior for images having an input coverage value which is less than a certain input coverage value.

When, however, a CMB carrier is used for the toner as described above, movement of charges are facilitated by electrostatic induction to the carrier near an image, making it possible to form a developing electrode in proximity of an electrostatic latent image of the photoreceptor. With such a structure, the strength of the electric field is increased even in the region of low input coverage compared to IMB (Insulating Magnetic Brush) carriers and the image can be developed with superior reproducibility. In addition, because the developing electrode is formed nearer to the photoreceptor, variation in the distance between the developing electrode and the photoreceptor is small even when the development gap varies due to a deviation of the center of a developing roller, resulting in an advantage that local variation in the development electric field within an image of uniform density can be inhibited, so that uniform image can be easily obtained.

As a reason for simultaneously achieving prevention of image deficiencies such as brush marks and carrier-overs , it can be considered that, because a conductive powder having a high resistivity is used within a layer coating the carrier, a number of conductive paths having a high resistivity is formed unlike in a case wherein carbon black having a low resistivity is used, resulting in a higher voltage for dielectric breakdown which occurs when an intense electric field is applied. It can be understood that phenomena such as brush marks and carrier-overs can be inhibited by such a configuration.

In addition, with the use of a low resistivity core in the carrier, it is possible to use a coat layer having a relatively high resistivity even though the carrier is a CMB carrier. This configuration enables utilization of the characteristics of the CMB carrier while strengthening the carrier against breakdown. Specifically, when a conductive material is placed under an electric field, charges realign themselves along the electric field, which is commonly referred to as polarization. The rate of the polarization is related to the resistivity of the conductive material, and increases as the resistivity is decreased. It can be considered that the polarization process occurs within the core of the carrier placed between the developing roller and the photoreceptor. When the resistivity of the core is sufficiently low and polarization within the core is completed within a period of approximately $10^{-3}$ seconds which is the time it takes for development to complete, in addition to the charge injection from the developing roll, a developing electrode effect due to the polarization of the core itself may also be present, resulting in a superior solid image.

(2) According to another aspect of the present invention, there is provided a method for forming an image, comprising a latent image processing stage for forming an electrostatic latent image on an electrostatic latent image holding member; a developing stage for developing the electrostatic latent image using a developer; a transfer stage for transferring a toner image formed through the development to a transfer material; and a fixation stage for fixing the toner image on the transfer material, wherein the developer is an electrophotographic developer as described above.

(3) According to another aspect of the present invention, there is provided an image forming apparatus, comprising latent image processing means for forming an electrostatic latent image on an electrostatic latent image holding member; developing means for developing the electrostatic latent image using a developer; transfer means for transferring a toner image formed by development onto a transfer material; and fixation means for fixing the toner image on the transfer material, wherein the developer is an electrophotographic developer as described above.

DESCRIPTION OF PREFERRED EMBODIMENT

Figure 1:
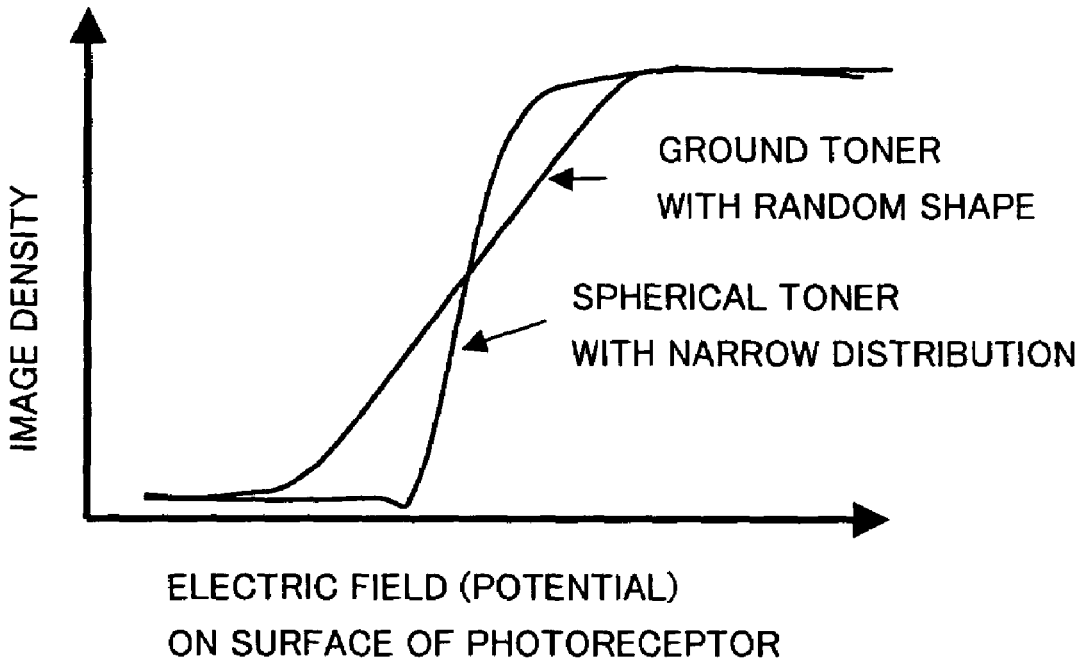
FIG. 1 shows relationships between surface potential of a photoreceptor and image density.

A preferred embodiment of the present invention will be described in the following. First, the toner particle will be described.

[Toner Particle]

A toner particle to be contained in the toner for electrostatic latent image developer according to the preferred embodiment of the present invention contains a binder resin and a colorant as necessary constituents and may optionally contain a release agent or a release agent resin as desired. As the binder resin to be contained in the toner particle according to the present embodiment, there is no limitation and binder resins used conventionally in toners can be used. Examples include, for example, styrenes such as styrene, para-chloro styrene, and α-methyl styrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylene unsaturated acid monomers such as acrylic acid, methacrylic acid, and sodium styrenesulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; homopolymers of monomers such as olephins such as ethylene, propylene, and butadiene; copolymers in which two or more monomers described above are combined; a mixture of such monomers and/or copolymers; non-vinyl condensed resins such as epoxy resin, polyester resin, polyurethane resin, polyamide resin, cellulose resin, and polyether resin; combination of these non-vinyl condensed resins and the vinyl resins described above; and graft copolymers obtained by polymerizing vinyl monomers under the presence of the non-vinyl condensed resins.

As described, a toner particle in the present embodiment can contain a release agent or a release agent resin. The release agent or release agent resin can be added as a part of the binder resin constituents. Examples of the release agent used herein include, for example, low molecular weight polyolephins such as polyethylene, polypropylene, and polybutene; fattyacyl amidos such as silicones, amido oleate, amido erucate, amido ricinoleate, and amido stearate;

plant-based wax such as carnauba wax, rice wax, candelilla wax, sumacs wax, and jojoba oil; animal-based wax such as beeswax; mineral-based wax and petroleum-based wax such as montan wax, ozokerite, ceresin, paraffin wax, microcrystalline wax, and Fischer-Tropsh wax; and modified products thereof. Among these materials, it is preferable that at least one type be present in the toner particle.

As the colorant to be used in the toner particle of the present embodiment, any conventionally known colorant can be used and there is no limitation. Examples include, for example, various pigments such as carbon black, chrome yellow, Hansa yellow, benzidine yellow, indanthrene yellow, quinoline yellow, permanent orange GTR, pyrazolone orange, Vulcan orange, Watchung red, permanent red, brilliant carmine 3B, brilliant carmine 6B, dupont oil red, pyrazolone red, lithol red, rhodamine B lake, lake red C, rose bengal, aniline blue, ultra marine blue, charcoal blue, methylene blue-chloride, phthalocyanine blue, phthalocyanine green, and malachite green oxalate; and various dyes such as acridine-based dye, xanthane-based dye, azo-based dye, benzoquinone-based dye, azine-based dye, anthraquinone-based dye, thioindigo-based dye, dioxazine-based dye, thiazine-based dye, azomethine-based dye, indigo-based dye, phthalocyanine-based dye, aniline black-based dye, polymethine-based dye, triphenyl methane-based dye, diphenyl methane-based dye, and thiazole-based dye, wherein the pigments and dyes can either be used as a single entity or as a combination.

The toner particle according to the present embodiment may contain various other constituents in addition to the above-described constituents in order to control various characteristics. For example, when the toner is used as a magnetic toner, it is possible to contain, for example, a metal such as magnetic powder (for example, ferrite and magnetite), reduced iron, cobalt, nickel, and manganese; an alloy of these metals; and a compound including these metals. In addition, if necessary, various charge normally employed controllers, such as quaternary ammonium salt, nigrosine-based compound, and triphenyl methane-based pigment, may be included.

The toner particle according to the present embodiment and containing the above-described constituents has a shape factor of 140 or less, more preferably, 135 or less and an average volume particle size of 1 μm or greater and 13 μm or less, more preferably in a range of 3 μm–8 μm, and, even more preferably, in a range of 4 μm–7 μm. When the shape factor is within the above-described range, images can be obtained with desirable image quality characteristics. When the shape factor exceeds 140, the transferability is reduced and uniform image quality cannot be achieved. When the average volume particle size is less than 1 μm, problems tend to occur in the sufficient characteristics of ease of cleaning and development. When, on the other hand, the average volume particle size exceed 13 μm, there is a problem in that sharp images cannot be obtained. In addition, it is preferable that the average volume particle size distribution GSDv of the toner is 1.3 or less. When GSDv exceeds 1.3, the toner particle distribution is too wide, resulting in reduction in the transferability and degradation in the halftone. The shape factor is represented by the following equation I, $$\text{Shape Factor}=(ML^2/A)\times(\Pi/4)\times 100 \quad \text{(Equation I)}$$

wherein ML represents the absolute maximum length of the toner particle and A represents the projected area of the toner particle.

The volume average particle size distribution GSDv is represented by the following equation II, $$GSDv=(D84/D16)^{1/2} \quad \text{(Equation II)}$$

wherein volume D16 indicate a particle size where an accumulated volume becomes 16% in an accumulation distribution from smaller particle size and volume D84 indicate a particle size where the volume accumulation becomes 84% in the distribution.

Any method for obtaining toner particles satisfying the above conditions may be employed, examples of such including a dry high-speed mechanical shock method wherein a spherical toner particle satisfying the above conditions is obtained through mechanical shock from a randomly shaped toner particle obtained by normal grinding; a wet fusion ensphere method of randomly shaped toners within a dispersion medium; and a toner creating methods through known polymerization such as suspension polymerization, dispersion polymerization, and emulsion polymerization aggregation. The toner particles obtained in such a manner can be treated using any conventionally known external additives.

[Electrophotographic Carrier]

In an electrophotographic carrier according to the present embodiment, a low resistivity ferrite is particularly preferable as a carrier core (that is, core material). As a carrier core other than ferrite, iron powder and magnetite are known. However, because the iron powder has a large specific weight, the impact to the toner is large and toner and additives tend to adhere, resulting in less stability compared to the ferrite having a lower specific weight. Moreover, with regard to magnetite, control to reduce the resistivity is difficult and the latitude of the resistivity is narrow, and, thus, magnetite is inferior to ferrite. On the other hand, when ferrite is used, it is possible to lower the resistivity through reduction at a certain temperature in, for example, hydrogen jet after calcination. In addition, ferrite has a further advantage that various resistivity can be achieved by controlling the rate of hydrogen circulation, temperature, reduction period, etc.

The carrier core used in the present embodiment has a dynamic electric resistivity of 1 Ω·cm or less under an electric field of $10^4$ V/cm when measured in a form of a magnetic brush. When the resistivity exceeds 1 Ω·cm, a carrier having a resistivity of a desired value or less cannot be obtained unless the resistivity of the coat resin layer is significantly reduced. When, however, the resistivity of the coat resin layer is significantly reduced, image deficiency occurs. The electric field of $10^4$ V/cm is similar to the actual developing electric filed, and, therefore, the resistivity is defined under such an electric field.

The dynamic electrical resistivity of the carrier is determined as follows. A carrier of approximately 30 $cm^3$ is placed on a developing roller to form a magnetic brush and a planer electrode having an area of 3 $cm^2$ is placed to oppose the developing roller with a distance of 2.5 mm therebetween. While rotating the developing roller at a rotational speed of 120 rpm, a voltage is applied between the developing roller and the planer electrode and the current flowing in this condition is measured. From the obtained current-voltage characteristic, the resistance is calculated using Ohm's law. It is well known that a relationship log (J) being proportional to $E^{1/2}$ holds between the applied voltage E and the current density J (for example, refer to Japanese Journal of Applied Physics, Vol. 19, No. 12, p. 2413-). When the resistivity is very small, as in the carrier of the present embodiment, it may not be possible to measure a high electric current at a high electric field of $10^3$ V/cm or greater. In this case, measurements are made in at least three points at the lower electric field region and extrapolation is performed using the relationship mentioned above and through the method of least squares to an electric field of $10^4$ V/cm.

The average volume particle size of the carrier core is preferably 10 μm–100 μm, and, more preferably, 30 μm –60 μm. When the average volume particle size is less than 10 μm, spread of the developer from the developer device easily occurs, and, when, on the other hand, the average volume particle size exceeds 100 μm, it is difficult to obtain sufficient image density. Examples of the material for the coat resin layer to be formed on the core (core material) include, for example, polyolefin-based resins such as polyethylene and polypropylene; polyvinyl-based and polyvinylidene-based resins such as polystyrene, acrylic resin, polyacrylonitrile, polyvinyl acetate, polyvinyl alcohol, polyvinyl butyral, polychlorovinyl, polyvinyl carbazole, polyvinyl ether, and polyvinyl ketone; copolymers of vinyl chloride and vinyl acetate; copolymers of styrene and acrylic acid; straight silicon resins made of organosiloxane binding or modified products thereof; fluorine resins such as polytetrafluoro ethylene, polyfluorovinyl, polyfluorovinylidene, and polychlorotrifluoroethylene; polyester; polyurethane; polycarbonate; amino resins such as urea-formaldehyde resin; and epoxy resins. These materials may be used as a single entity or a mixture of a plurality of resins may be used.

The thickness of the coat resin layer is preferably 0.3 μm to 5 μm, more preferably 0.5 μm to 3 μm. When the thickness of the coat resin layer is less than 0.3 μm, it is difficult to form a uniform coat resin layer on the core surface, and, in a case wherein a low-resistivity core is used as in the present embodiment, charge movement via the exposed surface occurs and image deficiency tends to occur. When, on the other hand, the thickness exceeds 5 μm, granulation between carriers occur and uniform carrier cannot be obtained.

The conductive powder to be added to the coat resin layer preferably has a resistivity of 10 Ω·cm or greater and $10^6$ Ω·cm or less and an average volume particle size of 10 nm–500 nm. When the average volume particle size of the conductive powder is less than 10 nm, aggregation of the conductive powders occurs, making it difficult to disperse the conductive powder in the layer. When, on the other hand, the average volume particle size exceeds 500 nm, it becomes difficult to introduce the conductive powder into the coat resin layer, resulting in exposure of conductive powder particles outside the coat layer, a greater tendency for a dielectric breakdown to occur, and/or inability to adjust the electric resistivity of the coat resin layer in a predetermined range.

The electric resistivity of the conductive powder was measured using a resistivity meter loresta AP manufactured by Mitsubishi Chemical Corporation using a four probe method. 2 g of measurement sample was filled into an aluminum cap and a pressure of 2 ton/cm$^2$ was applied using a pressurizing and forming system to create a measurement disk. Then, the surface of the disk was cleaned using a brush and four probes of the loresta AP was contacted to the sample, the resistivity was measured, and the volume specific resistivity was calculated.

Specific examples of the conductive powder include, for example, zinc oxide, titanium oxide, tin oxide, iron oxide, and titanium black. The content of the conductive powder in the coat resin layer is preferably 3 volume % to 45 volume %, more preferably, 10 volume % to 40 volume %. When the content of the conductive powder is less than 3 volume %, the resistivity of the coat resin layer is not sufficiently reduced to a desired value. When, on the other hand, the content of the conductive layer exceeds 45 volume %, the coat resin layer becomes fragile, resulting in partial exposure of the core during the use, which causes movement of charges and, consequently, a higher tendency for image deficiency.

The electric resistivity of the coat resin layer is preferably 10 Ω·cm to $1\times10^8$ Ω·cm, more preferably, $10^3$ Ω·cm to $10^7$ Ω·cm. The electric resistivity of the coat resin layer can be controlled by selecting the type, amount, etc. of the conductive powder and coating resin to be used. When the electric resistivity of the coat resin layer is lower than 10 Ω·cm, it becomes easier for the charges to move on the carrier surface, as a result, there are some cases where image deficiencies happen. When, on the other hand, the electric resistivity of the coat resin layer exceeds $1\times10^8$ Ω·cm, there are some cases where no superior solid image can be obtained even when a core with minimum possible resistivity is used. The electric resistivity of the coat resin layer is calculated by forming a coat resin film having a thickness of approximately few μm on an ITO conductive glass substrate using an applicator or the like, forming a gold electrode over the coat resin film through evaporation, measuring current and voltage under an electric field of $10^2$ V/cm, and calculating the electric resistivity from the current and voltage.

A preferable range of the electric resistivity of the carrier having the surface coated with the resin is preferably 10 Ω·cm to $1\times10^8$ Ω·cm, more preferably, from $1\times10^3$ Ω·cm to $1\times10^7$ Ω·cm. When the resistivity of the carrier is less than 10 Ω·cm, image deficiencies tend to occur. When, on the otherhand, the resistivity of the carrier exceeds $10^8$ Ω·cm, the advantages of the present embodiment cannot be obtained.

As a method for forming a coat resin layer on the carrier core, various methods can be used including, but not limited to, immersion wherein the carrier core is immersed in a solution for forming the coat resin layer, spraying wherein the solution for forming the coat resin layer is sprayed on the surface of the carrier core, flowing bed method wherein the solution for forming the coat resin layer is sprayed while the carrier core is floated using a flowing air, and a kneader coater method wherein the carrier core and the solution for forming the coat resin layer are mixed within a kneader coater and the solvent is then removed.

The solvent to be used for the applied solution for forming the coat resin layer is not limited as long as the solvent dissolves the resin, and examples include, for example, aromatic hydrocarbons such as toluene and xylane, ketones such as acetone and methylethyl ketone, and ethers such as tetrahydrofuran and dioxane. Example methods for dispersing the conductive powder include, for example, sand mill and homomixer.

A known additive such as charging controller and fixation helper may be added to the toner as desired. The toner concentration when the toner and carrier are mixed to create the developer is preferably between 0.3 weight % to 30 weight %, and more preferably, from 3 weight % to 20 weight %.

[Image Forming Method]

In an image forming method according to the present embodiment, an image can be formed by forming a latent image on an electrostatic carrier, developing the latent image using the electrostatic latent image developer as described, transferring the developed toner image to a transfer material, and heating and fixing the toner image on the transfer material.

Furthermore, the electrostatic latent image developer as described can also be used when an image is formed by forming an electrostatic latent image on an electrostatic charge image carrier using laser beam with a dot-concentrated screen (line-screen or dot-screen).

In addition, the electrostatic latent image developer as described can also be used when an image is formed through a method wherein in the latent image processing stage, when exposing means applies an image exposure process corresponding to an image signal to form an electrostatic latent image, the image signal to be output to the exposing means is processed so that the output image signal is produced by comparing the input image signal and a threshold value matrix to which threshold values are stored in advance for determining whether or not each pixel within a screen cell comprising a plurality of pixels in a dot-concentrated type screen is to be recorded, and wherein the threshold value matrix is a threshold value matrix in which, when a non-linear region is present in a part of the image signal-output density characteristic, linearity is improved by inserting, between threshold values of the non-linear region in the image signal-output density characteristic where the slope is large, non-recording isolated pixels which are a pixel before and a pixel after in the main scan direction of the target pixel to be switched on, the non-recoding isolated pixels being switched off.

In an image forming method employed in the present embodiment, an isolated pixel is prepared in which the width of a main scan direction (along the axial direction of photoreceptor drum) is changed, output characteristics when the isolated pixel is output using an electrophotographic copier are determined in advance, and a width of one pixel is set according to the conditions of the toner image formation. Here, the "isolated pixel" refers to a pixel immediately before or after, in the main scan direction, the target pixel to be switched on and the isolated pixel is switched off. In addition, in the present embodiment, an isolated pixel which is not recorded is inserted between threshold values in a non-linear portion of the curve representing a relationship between the image signal and the output density characteristics, the non-linear portion having a large slope, to the conventional threshold value matrix for creating a dot-concentrated screen to create a new threshold value matrix and the linearity of the curve representing the relationship between the image signal and the output density characteristic is improved using the new threshold value matrix. An output image signal is produced using the new threshold value matrix wherein linearity is improved. With such a structure, it is possible to prevent deterioration of particle characteristics and reduction in the resolution due to the periodical structure of the screen, and, at the same time, the halftone image can be desirably reproduced even when the gradation reproducing characteristic changes due to, for example, history and environmental changes in the photoreceptor, developer, and electrophotographic device.

Moreover, according to the present embodiment, the distance between the electrostatic latent image holding member and the developer carrier holding the developer in the image forming apparatus, that is, the distance between the photoreceptor and the sleeve of the developer device is preferably 350 μm or less. When the distance exceeds 350 μm and the developing gap varies due to a deviation of the center of the developing roll, the distance between the sleeve and the photoreceptor significantly varies, resulting in local variation of the developing electric field even in an image to be formed with uniform density, causing non-uniform image formation and possible color unevenness.

By using the electrostatic latent image developer according to the embodiment, even when the peripheral speed of the photoreceptor in the image forming apparatus is set to be 200 mm/sec. or greater, or, more preferably, 300 mm/sec. or greater (intermediate speed to high speed), superior image quality can be achieved.

[Electrophotographic Developer]

According to another aspect of the present invention, it is preferable that an electrophotographic developer as described above is used with a distance between an electrostatic latent image holding member (for example, photoreceptor) and a developer holding member holding the developer (for example, sleeve of a developer device) of 350 μm or less.

According to another aspect of the present invention, it is preferable that the electrophotographic developer is used with a peripheral speed of the electrostatic latent image holding member (for example, photoreceptor) of 200 mm/sec. or greater, more preferably, 300 mm/sec. or greater.

According to still another aspect of the present invention, it is preferable that, in the electrophotographic developer, the thickness of the coat resin layer of the carrier is 0.3 μm to 5 μm.

According to another aspect of the present invention, it is preferable that, in an electrophotographic developer as above, the average volume particle size of the carrier is 10 μm to 100 μm.

According to yet another aspect of the present invention, it is preferable that, in the electrophotographic developer, the core material of the carrier is made of ferrite or magnetite, more preferably, ferrite.

According to another aspect of the present invention, it is preferable that, in an electrophotographic developer as above, the conductive powder contained in the coat resin layer of the carrier is contained in an amount of 3 volume % to 45 volume % with respect to the coat resin layer According to another aspect of the present invention, it is preferable that, in the electrophotographic developer, the toner is produced through an emulsion polymerization aggregation method.

EXAMPLES

[Manufacture of Spherical Toner Particle X-1]

As a toner particle constructing the toner for electrostatic latent image developer of the present embodiment, a toner particle X-1 is prepared through emulsion polymerization aggregation described below.

A resin particulate dispersion liquid A-1, release agent particulate dispersion liquid B-1, pigment dispersion liquid C-1 are prepared in advance through the following methods for use in preparation of the toner particle X-1.

(Resin Particulate Dispersion Liquid A-1)

A solution is prepared by mixing the following constituents:

| | |
|---|---|
| Styrene | 320 parts by weight |
| n-butyl acrylate | 80 parts by weight |
| Acrylic acid | 10 parts by weight |
| Dodecanethiol | 10 parts by weight |

This solution of 434 parts by weight, 6 parts by weight of a non-ionic surfactant (NONIPOL 400 manufactured by Sanyo Kasei Co., Ltd), and 10 parts by weight of an anionic surfactant (NEOGEN R manufactured by Dai-ichikogyo Seiyaku Co., Ltd.) is dissolved in 550 parts by weight of an ion exchange solvent. The solution is then introduced in a flask and dispersion and emulsification are allowed to occur. While slowly stirring and mixing for 10 minutes, 50 parts by weight of ion exchange solution to which 4 parts by weight of ammonium persulfate was dissolved is introduced. Then, after the inside of the flask is sufficiently replaced with nitrogen, the flask is heated in an oil bath while stirring until the temperature of the system reaches 70° C. Emulsification polymerization is allowed to continue for 5 hours and a resin particulate dispersion liquid A-1 is obtained.

In a latex obtained in the resin particulate dispersion liquid A-1, the average volume particle size ($D_{50}$) of the resin particulates is measured using a laser diffraction particle size distribution measuring device (LA-700 manufactured by Horiba, Ltd.) and is 155 nm. Similarly, a measurement of glass transition point of the resin using a differential scanning calorimeter (DSC-50 manufactured by Shimadzu Corporation) with an temperature increase rate of 10° C./min yields a glass transition point of 54° C. and a measurement of the weight average molecular weight (in polystyrene equivalent value) using a molecular weight measurement device (HLC-8020 manufactured by Tosoh Corporation) with THF as solvent yields a value of 30,000.

(Release Agent Particulate Dispersion liquid B-1)

After the following constituents are sufficiently dispersed while heating to 95° C. with a homogenizer (Ultra Tarax T50 manufactured by LKA Corporation), the solution is transferred to a pressure discharging homogenizer for dispersion treatment, and a release agent particulate dispersion liquid B-1 having an average volume particle size ($D_{50}$) of 550 nm is obtained.

| | |
|---|---|
| Paraffin Wax (HNP0190 manufactured by Nippon Seiro Co. Ltd, having a melting point of 85° C.) | 50 parts by weight |
| Cationic surfactant (SANISOL B50 manufactured by Kao Corporation) | 5 parts by weight |
| Ion Exchange Solution | 200 parts by weight |

(Pigment Dispersion Liquid C-1)

The following constituents are dispersed for 10 minutes using a homogenizer (Ultra Tarax T50 manufactured by LKA Corporation) and then dispersed using an ultrasonic homogenizer, to obtain a blue pigment dispersion liquid C-1 having an average volume particle size ($D_{50}$) of 150 nm.

| | |
|---|---|
| Phthalocyanine Pigments (PB-FAST BLUE manufactured by BASF Corporation) | 50 parts by weight |
| Anionic Surfactant (NEOGEN R manufactured by Dai-ichikogyo Seiyaku Co., Ltd.) | 5 parts by weight |
| Ion Exchange Solution | 200 parts by weight |

(Preparation of Toner Particle X-1)

The following constituents are introduced in a spherical flask made of stainless steel and sufficiently mixed and dispersed using a homogenizer (Ultra Tarax T50 manufactured by LKA Corporation). The content within the flask is then heated to a temperature of 50° C. while stirring in a heating oil bath, the system is maintained at this temperature for 30 minutes, the temperature of the heating oil bath is raised to 55° C., and the temperature is maintained for 1 hour to adjust the particle size and particle size distribution of the aggregated toner particle X-1 (this stage is referred to as the "aggregation stage").

| | |
|---|---|
| Resin particulate dispersion liquidA-1 | 200 parts by weight |
| Release agent dispersion liquid B-1 | 40 parts by weight |
| Pigment dispersion liquid C-1 | 11.3 parts by weight |
| Cationic surfactant (Sunnyzole B50 manufactured by Kao Corporation) | 0.5 parts by weight |

The average volume particle size ($D_{50}$) of the toner particle X-1 is measured using a coulter counter (TAII manufactured by Nikkaki Corp.), and is 5.0 μm with the average volume particle size distribution (GSDv) being 1.21. Here, the average volume particle size ($D_{50}$) and the volume average particle size distribution (GSDv) are defined as follows. An accumulation distribution is drawn from smaller particle size with respect to a divided particle size range (channel) in the measured particle size distribution, volume D16 is defined as the particle size where the volume accumulation becomes 16%, volume $D_{50}$ is defined as the particle size where the volume accumulation reaches 50%, and the volume D84 is defined as the particle size where the volume accumulation reaches 84%. The average volume particle size $D_{50}$ is defined as the volume accumulation 50% and the volume average particle size distribution GSDv is defined as a value calculated as $(D84/D16)^{1/2}$.

3 parts by weight of an anionic surfactant (NEOGEN R manufactured by Dai-ichikogyo Seiyaku Corporation) is added to the aggregated toner particle dispersion liquid, the aggregation of the particles is stopped, the aggregated toner particles are stabilized, and the stainless steel flask is sealed. Then, the system is heated to a temperature of 90° C. while stirring is continued using a magnetic seal and this temperature is maintained for 3 hours to allow fusion of the aggregated toner particles and to adjust the shape and shape distribution (this stage is referred to as "coalesce" stage). At this point, the measurement of the average volume particle size ($D_{50}$) of the fused toner particles using a coulter counter (TAII manufactured by Nikkaki Corporation) yields a value of 5.5 μm and the average volume particle size distribution (GSDv) is 1.21.

After the fused toner particle is cooled, a filtration process is applied, the fused toner particle is thoroughly washed using an ion exchange solution having a pH of 10, thoroughly washed using an ion exchange solution having a pH of 6.5, and is dried using a freeze dryer to obtain the toner particle X-1. A measurement of the average volume particle size ($D_{50}$) of the toner particle using the coulter counter (TAII manufactured by Nikkaki Corporation) yields a value of 5.5 μm and the volume average particle size distribution (GSDv) is 1.21.

The surface condition of the toner particle X-1 is observed using an electron microscope. A continuous layer wherein resin particulates are fused on the surface of the toner particle X-1 is observed. In observation of a cross section of the toner particle X-1 by a transmissive electron microscope, no exposure of pigments on the outer surface layer is observed. Moreover, using a luzex image analyzer (LUZEX III manufactured by Nireco Corporation), the absolute maximum length of toner (ML) and projected areas (A) of 100 toners are measured, values for SF are calculated, and an average value of the shape factor SF is calculated, yielding a center shape factor of 132.

To 100 parts by weight of the toner particle, 1.2 parts by weight of hydrophobic silica (TS720 manufactured by Cabot Corporation), 0.5 parts by weight of titanium oxide, and 1 parts by weight of large particle size silica are added and these materials are mixed in a sample mill to obtain the final toner.

[Manufacture of Spherical Toner Particle X-2]

A spherical toner particle X-2 with a center shape factor of 115 is obtained through a method wherein the same material is used and the same adjustment is performed through the aggregation stage as the toner particle X-1, the temperature in the coalesce stage is raised to 95° C., and the temperature is maintained for 5 hours. The average volume particle size ($D_{50}$) of the toner particle X-2 is 5.7 μm and the volume average particle size distribution (GSDv) is 1.3.

To 100 parts by weight of this toner particle, 1.2 parts by weight of hydrophobic silica (TS720 manufactured by Cabot Corporation), 0.5 parts by weight of titanium oxide, and 1 parts by weight of large particle size silica are added, the materials are mixed in a sample mill, and a final toner is obtained.

[Manufacture of spherical toner particle X-3]

| Polymerization constituents (Oil Phase) | |
|---|---|
| Styrene | 70 parts by weight |
| n-butyl methacrylate | 30 parts by weight |
| Charge control agent (Bontron S36 manufactured by Orient Chemical Industries Inc.) | 1 parts by weight |
| Magenta Pigments (C.I. Pigment Red122 manufactured by Dainichiseika Color & Chemicals Mfg. Co., Ltd.) | 5 parts by weight |
| Paraffin wax (HNP0190 manufactured by Nippon Seiro Co. Ltd, having a melting point of 85° C.) | 6 parts by weight |
| Polymerization starter (AIBN) | 4 parts by weight |
| Water Phase | |
| Water | 400 parts by weight |
| Polyvinyl alcohol | 10 parts by weight |

An oil phase formed of the above-described constituents is introduced into the water phase and suspended and dispersed using a TK homomixer (manufactured by TOKUSHU KIKA KOGYO Co., Ltd.). A normal stirring process is applied in a flask under a nitrogen atmosphere at 80° C. and polymerization is allowed to occur for 5 hours. The obtained particles are removed, washed with warm water, filtered, and dried to obtain a toner particle X-3 having an average volume particle size of 5.8 μm, a volume GSD of 1.27 and a center shape factor of 123.

To 100 parts by weight of this toner particle, 1.2 parts by weight of hydrophobic silica (TS720 manufactured by Cabot Corporation), 0.5 parts by weight of titanium oxide, and 1 parts by weight of large particle size silica are added and the materials are mixed in a sample mill to obtain the final toner.

A toner particle F-1 used in a comparative example will now be described.

[Manufacture of Randomly Shaped Toner Particle F-1]

A toner particle F-1 as described below is prepared for a comparative example.

| | |
|---|---|
| Linear polyester resin (linear polyester obtained from terephthalicacid/bisphenol A ethylene oxide additive/ cyclohexane dimethanol; Tg = 62° C., Mn = 4,000, Mw = 12,000, acid value = 12, base value = 25) | 100 parts by weight |
| Phthalocyanine pigments (PB-FAST BLUE manufactured by BASF) | 5 parts by weight |
| Wax (Purified Carnauba wax manufactured by Toa Kasei Co., Ltd.) | 7 parts by weight |

The mixture is mixed using an extruder, ground using a jet mill, and dispersed using wind-powered classifier to obtain a cyan toner having $D_{50}$ of 6.5 μm.

The shape factor of this toner is 148 and the GSDv is 1.35.

To 100 parts by weight of this toner particle, 1 parts by weight of hydrophobic silica (TS720 manufactured by Cabot Corporation) and 0.45 parts by weight of titanium oxide are added and the mixture is mixed using a sample mill to obtain the final toner.

Next, the manufacturing method of a carrier A used in the Examples of the present invention will be described.

[Manufacture of Carrier A]

| Carrier A | |
|---|---|
| Ferrite ("DFC450" manufactured by Dowa Teppun Corporation; average volume particle size = 35 μm) | 100 parts by weight |
| Toluene | 16.6 parts by weight |
| Copolymer of diethylaminoethylmethacrylate-styrene-methyl methacrylate ("PX-1A" manufactured by Sanyo Kasei Corporation; copolymerization ratio = 2:20:78; weight average molecular weight = 50,000) | 1.44 parts by weight |
| Antimony doped tin oxide coated with titanium oxide ("HI-2" manufactured by Ishihara Sangyo Corp., static electrical resistivity = $5 \times 10^4\ \Omega \cdot cm$, fiber length = 0.3 um, fiber size = 0.06 μm, aspect ratio = 5) | 3.31 parts by weight |
| Oxygen-defective tin oxide coated with barium sulfate ("Passtran TYPE-IV4350" manufactured by MITSUI-KINZOKU; static electric resistivity = $6 \times 10^4\ \Omega \cdot cm$, particle size = 0.1 μm) | 1.1 parts by weight |

Figure 2:
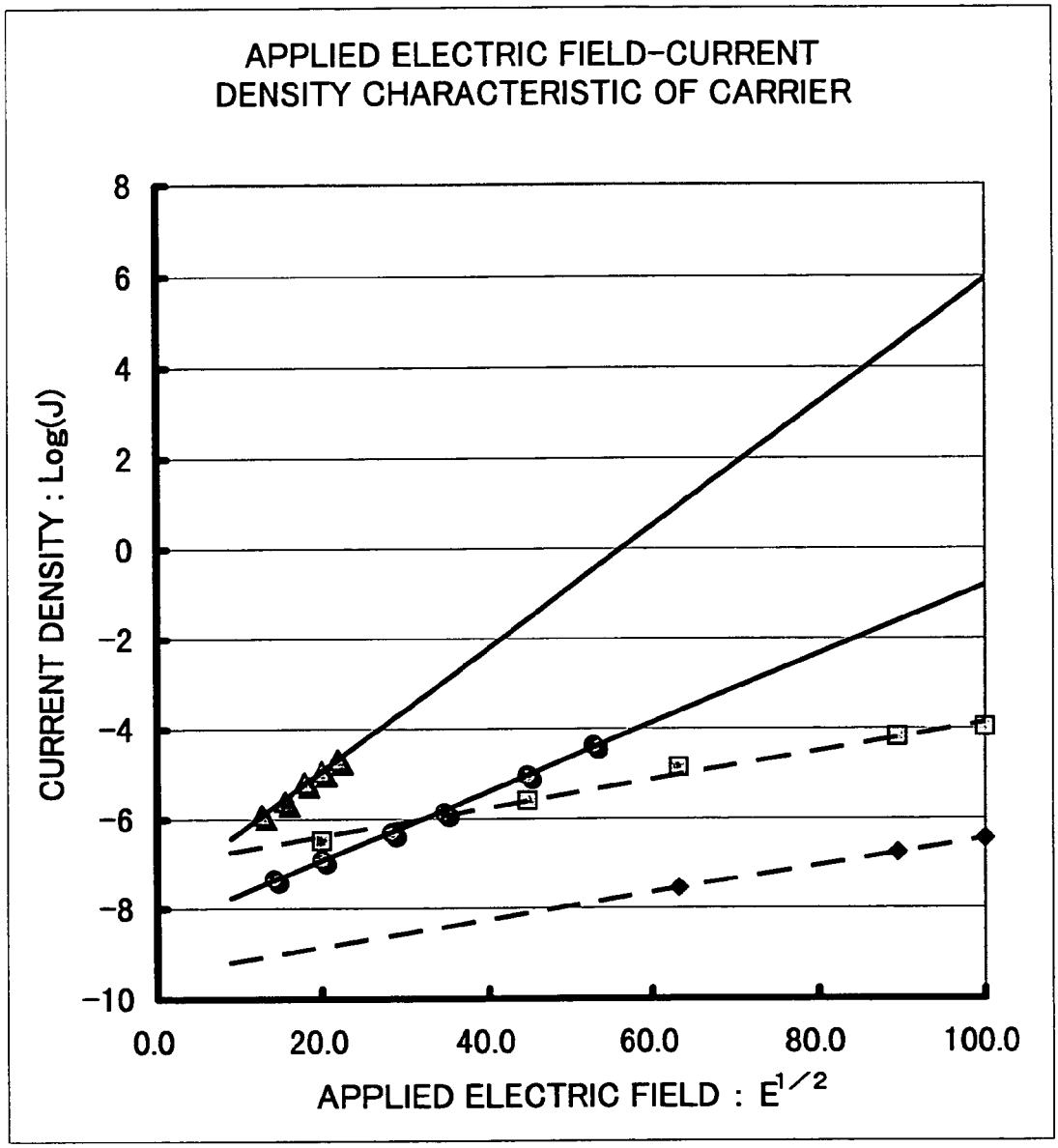
FIG. 2 shows graphs of relationships between current density J and applied electric field E when the resistivity of carrier is measured in a form of a magnetic brush, the graphs being extrapolated to an electric field of $10^4$ V/cm.

The constituents other than ferrite are dispersed for 1 hour using a sand mill to prepare a solution for forming a coat resin layer. Then, the solution for forming a coat resin layer and ferrite are introduced into a vacuum degassing kneader and are stirred for 20 minutes while the pressure is reduced at a temperature of 60° C. to form a coat resin layer and to obtain a carrier A. The thickness of the coat resin layer is 0.7

μm. The carrier A is observed using a scanning electron microscope, and it is observed that there is no exposed surface and the carrier is uniformly coated with the resin. Using an applicator, the solution for forming the coat resin layer is applied on an ITO conductive glass substrate to a thickness of 1 μm and then dried to obtain the coat resin layer. FIG. 2 shows results of resistivity measurements of the ferrite and the carrier A in the form of the magnetic brush. The extrapolated values for an electric field of $10^4$ V/cm are respectively $1.3\times10^{-2}$ Ω·cm and $7.9\times10^4$ Ω·cm. The resistivity value of the coat resin layer is $2\times10^4$ Ω·cm under an electric field of 100 V/cm.

A manufacturing method of a carrier B used in a Comparative Example will now be described.

[Manufacture of Carrier B]

| Carrier B | |
|---|---|
| Ferrite particle ("FEC-35" manufactured by POWDER TECH Corporation, average volume particle size = 35 μm) | 100 parts by weight |
| Toluene | 16 parts by weight |
| Copolymer of perfluoroacrylate (having a critical surface tension of 24 dyn/cm) | 1.82 parts by weight |
| Carbon black (average volume particle size = 30 nm, DBP value = 174 ml/100 g, resistivity $10^0$ Ω · cm or less, "VMX-72" manufactured by Cabot Corporation) | 0.5 parts by weight |
| Bridged melamine resin particle (average volume particle size = 0.3 μm, toluene insoluble) | 0.34 parts by weight |

The above-described constituents other than the ferrite particle is dispersed for 10 minutes using a stirrer to prepare a solution for forming a coat layer. Then, the solution for forming the resin coat layer and ferrite particles are introduced into a vacuum degassing kneader and stirred for 30 minutes at 60° C. The pressure is then reduced and toluene is eliminated through evaporation to form a resin coat layer and a carrier (in this process, carbon black diluted in toluene is dispersed using a sand mill in the copolymer of perfluoroacrylate which is the carrier resin). The average thickness of the resin coat layer is 0.6 μm. Through observation of the carrier B using a scanning electron microscope, it is confirmed that there is no exposed surface and resin is uniformly coated. Using an applicator, the solution for forming the coat resin layer is applied on an ITO conductive glass substrate to a thickness of 1 μm to obtain a coat resin film. FIG. 2 shows a result of resistivity measurement of the ferrite and carrier B in the shape of magnetic brush. Extrapolation of these graphs to an electric field of $10^4$ V/cm yield respectively values of $7.9\times10^7$ Ω·cm and $1.28\times10^{10}$ Ω·cm. The resistivity of the coat resin film is $8\times10^8$ Ω·cm under an electric field of 100 V/cm.

A manufacturing method of a carrier C used in an Example of the present invention will now be described.

| [Carrier C] | |
|---|---|
| Ferrite ("DFC450" manufactured by Dowa Teppun Corp., having an average volume particle size of 35 μm) | 100 parts by weight |
| Toluene | 16.6 parts by weight |
| Copolymer of diethylaminoethyl methacrylate-styrene-methyl methacrylate ("PX-1A" manufactured by Sanyo Kasei Corp.; copolymerization ratio = 2:20:78; weight average molecular weight = 50,000) | 1.44 parts by weight |
| Oxygen-defective tin oxide coated with barium sulfate ("Passtran TYPE-IV" manufactured by MITSUI-KINZOKU; static electric resistivity = $2\times10^1$ Ω · cm, particle size = 0.1 μm) | 1.1 parts by weight |

The constituents other than ferrite are dispersed for 1 hour using a sand mill to prepare a solution for forming a coat resin layer. Then, the solution for forming the coat resin layer and ferrite are introduced in a vacuum degassing kneader and are stirred for 20 minutes while the pressure is reduced under a temperature of 60° C. to form a coat resin layer and obtain a carrier C. The thickness of the coat resin layer is 0.6 μm. As a result of observation of the carrier C using a scanning electron microscope, it is confirmed that there is no exposed surface and the resin is uniformly coated. The solution for forming the resin coat layer is applied using an applicator on an ITO conductive glass substrate to a thickness of 1 μm and dried to obtain the coat resin layer. Resistivity for the ferrite and for the carrier C are measured in a form of a magnetic brush. The resistivity values extrapolated to an electric field of $10^4$ V/cm are respectively $1.3\times10^{-2}$ Ω·cm and 6×10 Ω·cm. The resistivity of the coat resin layer is 5×10 Ω·cm under an electric field of 100 V/cm.

A manufacturing method of carrier D used in an Example of the present invention will now be explained.

| [Carrier D] | |
|---|---|
| Ferrite ("DFC450" manufactured by Dowa Teppun Corp., average volume particle size = 35 μm) | 100 parts by weight |
| Toluene | 16.6 parts by weight |
| Copolymer of diethyl aminoethyl methacrylate-styrene-methyl methacylate ("PX-1A" manufactured by Sanyo Kasei Corp.; copolymerization ratio = 2:20:78; weight average molecular weight = 50,000) | 1.44 parts by weight |
| Oxygen-defective tin oxide coated with barium sulfate ("Passtran TYPE IV" manufactured by Mitsui Kinzoku, static electric resistivity = $4\times10^5$ Ω · cm, particle size = 0.1 μm) | 0.8 parts by weight |

The constituents other than ferrite are dispersed for 1 hour using a sand mill and a solution for forming a coat resin layer is prepared. Then, the solution for forming the coat resin layer and ferrite are introduced into a vacuum degassing kneader and are stirred for 20 minutes under reduced pressure and at a temperature of 60° C. to form a coat resin layer and obtain a carrier D. The thickness of the coat resin layer is 0.6 μm. Observation of the carrier D using a scanning electron microscope confirmed that there is no exposed surface and the resin is uniformly coated. The solution for forming coat resin layer is applied on an ITO conductive glass substrate using an applicator to a thickness of 1 μm and dried to obtain the coat resin layer. Resistivity of the ferrite and of the carrier D are measured in a form of a magnetic brush, and the resistivity values extrapolated to an electric field of $10^4$ V/cm are, respectively, $1.3\times10^{-2}$ Ω·cm and $8\times10^{7}$ Ω·cm. The resistivity of the coat resin layer is $5\times10^{7}$ Ω·cm under an electric field of 100 V/cm.

The prototype toners of Examples and Comparative Examples thus created are combined in a manner described in the following Table 1 to create a developer. Using a dot matrix electrophotographic copier (CDT60 manufactured by Fuji Xerox Corp.), a copying test is performed under an evaluation environment of a temperature of 22° C. and humidity of 55%. The evaluation item for the image in this examination is the reproducibility at Cin of 20%. More specifically, the reproducibility of fine dots by a laser is used for visible evaluation in grades of Grade 1 (G1) to Grade 5 (G5) (here, "G5" represents the best condition and "G1" represents the worst condition wherein image cannot be reproduced. A grade of "G4" or better is considered acceptable). A halftone image is created on a front surface of a sheet of A-4 size paper and, a 5 cm×5 cm area on the sheet is divided into 5×5 cells with a 1 cm pitch, the color reproducibility is measured in one point within the cell, an evaluation value E is calculated from $E=(a^{x2}+b^{x2}+L^{x2})^{0.5}$, and the average and the standard deviation of E are calculated. The speed of the photoreceptor in CDT60 is 264 mm/sec. and the distance between the photoreceptor and the developing sleeve is 325 μm.

TABLE 1

| | TONER | CARRIER | DOT REPRO-DUCIBILITY | STANDARD DEVIATION ΔE |
|---|---|---|---|---|
| Example 1 | X-1 | A | G5 | 2.5 |
| Example 2 | X-1 | C | G5 | 2.2 |
| Example 3 | X-1 | D | G4 | 3.0 |
| Example 4 | X-2 | A | G4 | 2.9 |
| Example 5 | X-3 | A | G5 | 2.3 |
| Comparative Example 1 | X-1 | B | G2 | 7.5 |
| Comparative Example 2 | F-1 | B | G3 | 6.7 |
| Comparative Example 3 | X-2 | B | G1 | 8.8 |

As can be seen from Table 1, in the combination of the toner and the carrier of Examples 1 through 5 of the present invention, the laser dot reproducibility is superior even in the low coverage region and unevenness in color reproduction of a solid image in the halftone portion can be maintained at a ΔE which can be identified by the naked eye of approximately 3. In contrast, with the highly resistive carriers in Comparative Examples 1 through 3, the laser dot reproducibility is inferior and the unevenness of solid image in the halftone portion in terms of ΔE becomes 3 or greater, which which can be distinguished by the naked eye and is therefore obviously not desirable.

In particular, when a developer having a randomly shaped toner particle is used as in the Comparative Example 2, although the laser dot reproducibility is superior to that in the Comparative Example 1, ΔE is 3 or greater, meaning that the image is unsatisfactory with regard to unevenness.

In addition, the laser dot reproducibility and the standard deviation when the developer of Example 1 is used with a speed of photoreceptor of TCD60 of 100 mm/sec. and the distance between the photoreceptor and the developing sleeve of 500 μm are G4 and 2.9, respectively, and thus, the fine line reproducibility is desirable.

With the use of the developer according to the embodiment, it is possible to produce high quality images having a superior laser dot reproducibility at a low coverage region with less unevenness in the color of solid halftone image. This is significantly advantageous, particularly in color imaging.

What is claimed is:

1. A method for forming an image, comprising:

a latent image processing stage for forming an electrostatic latent image on an electrostatic latent image holding member;

a developing stage for developing the electrostatic latent image using a developer;

a transfer stage for transferring a toner image formed through the development onto a transfer material; and a fixation stage for fixing the toner image on the transfer material, wherein the developer is an electrophotographic developer comprising:

a toner having a shape factor of 140 or less and a volume average particle size distribution GSDv of 1.3 or less; and an electrophotographic carrier having a coat resin layer on a core material, the coat resin layer containing a conductive powder, the core material having a dynamic electric resistivity of 1 Ω·cm or less under an electric field of $10^4$ V/cm in a form of a magnetic brush, the conductive powder having an electric resistivity of $10^1$ Ω·cm or greater and $10^6$ Ω·cm or less, and the carrier having an electric resistivity in a range between 10 and $1\times10^8$ Ω·cm, wherein the shape factor is defined by an equation, $$\text{Shape Factor}=(ML^2/A)\times(\pi/4)\times100$$

wherein ML represents the absolute maximum length of the toner and A represents the projected area of the toner, and the volume average particle size distribution GSDv is defined by an equation, $$GSDv=(D84/D16)^{1/2}$$

wherein volume D16 represents a particle size where an accumulated volume in an accumulation distribution from smaller size reaches 16% and volume D84 represents a particle size where the accumulated volume in the accumulation distribution reaches 84%, wherein in the latent image processing stage, when an exposing means applies an image exposure process corresponding to an image signal to form an electrostatic latent image, the image signal to be output to the exposing means is processed so that the output image signal is produced by comparing the input image signal and a threshold value matrix to which threshold values are stored in advance for determining whether or not each pixel within a screen cell comprising a plurality of pixels in a dot-concentrated type screen is to be recorded, wherein the threshold value matrix is a threshold value matrix in which, when a non-linear region is present in a part of the image signal-output density characteristic, linearity is improved by inserting, between threshold values of the non-linear region in the image signal-output density characteristic where the slope is large, non-recording isolated pixels which are a pixel before and a pixel after in the main scan direction of the target pixel to be switched on, the non-recoding isolated pixels being switched off, and wherein the peripheral speed of the electrostatic latent image holding member is 200 mm/sec or greater.

2. A method for forming an image according to claim 1, wherein in the developing stage for developing the electrostatic latent image using a developer, the distance between the electrostatic latent image holding member and a developer holding member holding the developer is 350 μm or less.

3. A method for forming an image according to claim 1, wherein the peripheral speed of the electrostatic latent image holding member is 300 mm/sec. or greater.

4. An image forming apparatus comprising:

latent image processing means for forming an electrostatic latent image on an electrostatic latent image holding member;

developing means for developing the electrostatic latent image using a developer; wherein the developing means contains the developer;

transfer means for transferring a toner image formed by development onto a transfer material; and fixation means for fixing the toner image on the transfer material, wherein the developer is an electrophotographic developer according to claim 1.

5. An image forming apparatus according to claim 4, wherein the latent image processing means forms an electrostatic latent image on the electrostatic latent image holding member using a laser beam and with a dot-concentrated type screen.

6. An image forming apparatus according to claim 4, wherein in the developing means for developing the electrostatic latent image using a developer, the distance between an electrostatic latent image holding member carrier and the developer carrier holding the developer is 350 μm or less.

7. An image forming apparatus according to claim 4, wherein the peripheral speed of the electrostatic latent image holding member carrier is 200 mm/sec. or greater.

8. An image forming apparatus according to claim 7, wherein the peripheral speed of the electrostatic latent image holding member is 300 mm/sec. or greater.

9. An image forming apparatus according to claim 4, wherein the latent image processing means processes, when exposing means applies an image exposure process corresponding to an image signal to form an electrostatic latent image, the image signal to be output to the exposing means so that the output image signal is produced by comparing the input image signal and a threshold value matrix to which threshold values are stored in advance for determining whether or not each pixel within a screen cell comprising a plurality of pixels in a dot-concentrated type screen is to be recorded, and wherein the threshold value matrix is a threshold value matrix in which, when a non-linear region is present in a part of the image signal-output density characteristic, linearity is improved by inserting, between threshold values of the non-linear region in the image signal-output density characteristic where the slope is large,- non-recording isolated pixels which are a pixel before and a pixel after in the main scan direction of the target pixel to be switched on, the non-recoding isolated pixels being switched off.

* * * * *